US006810946B2

(12) United States Patent
Hoang

(10) Patent No.: US 6,810,946 B2
(45) Date of Patent: Nov. 2, 2004

(54) LOOP HEAT PIPE METHOD AND APPARATUS

(75) Inventor: Triem T. Hoang, Clifton, VA (US)

(73) Assignee: TTH Research, Inc., Laurel, MD (US)

( * ) Notice: Subject to any disclaimer, the term of this patent is extended or adjusted under 35 U.S.C. 154(b) by 0 days.

(21) Appl. No.: 10/324,005

(22) Filed: Dec. 20, 2002

(65) Prior Publication Data

US 2003/0159808 A1 Aug. 28, 2003

Related U.S. Application Data

(60) Provisional application No. 60/341,791, filed on Dec. 21, 2001, and provisional application No. 60/361,305, filed on Mar. 4, 2002.

(51) Int. Cl.[7] ..... F28D 15/00

(52) U.S. Cl. ..... 165/104.26; 165/104.24

(58) Field of Search ..... 165/41, 104.26, 165/185, 104.33, 104.25, 104.22, 104.23, 104.24

(56) References Cited

U.S. PATENT DOCUMENTS 4,492,266 A * 1/1985 Bizzell et al. ..... 165/104.26
5,103,897 A * 4/1992 Cullimore et al. ..... 165/104.26
5,944,092 A * 8/1999 Van Oost ..... 165/104.26
6,227,288 B1 * 5/2001 Gluck et al. ..... 165/104.26

FOREIGN PATENT DOCUMENTS

BE WO 97/00416 1/1997

* cited by examiner

*Primary Examiner*—Ljiljana Ciric
(74) *Attorney, Agent, or Firm*—Swidler Berlin Shereff Freidman, LLP

(57) ABSTRACT

An Advanced Loop Heat Pipe ("ALHP") apparatus, for passively transporting waste heat over a long distance and rejecting it to a heat sink for heat rejection, an evaporator capillary pump ("ECP") for heat acquisition, includes a reservoir for storing the working fluid of the ALHP, an auxiliary pump for vapor management of the liquid side of the loop, a primary condenser for condensation of vapor from the ECP, and a secondary condenser for condensation of vapor from the reservoir. The reservoir, ECP, and condenser are connected by transport lines to provide a conduit for the working fluid to flow from one component to another. The reservoir also connects to the auxiliary pump by an auxiliary pump transport line via the condenser. The auxiliary pump further connects to the condenser by a vapor transport line.

12 Claims, 1 Drawing Sheet

LOOP HEAT PIPE METHOD AND APPARATUS

This application claims of Provisional Appl. 60/341,791 filed Dec. 21, 2001 and Provisional Appl. 60/361,305 filed Mar. 4, 2002.

FIELD OF THE INVENTION

The present invention generally relates to controlling the temperature of a device and, more particularly, to controlling the temperature of a device using a fluidic closed loop cooling system robust against fluid accumulation and capable of fast startup and operation in high temperature and cryogenic temperature ranges, for use primarily in aerospace, electronic, and military applications.

BACKGROUND OF THE INVENTION

Two types of closed loop cooling systems are capillary pumped loops ("CPL") and loop heat pipes ("LHP"). Both are passive heat transport systems and contain no mechanical moving parts. Both the CPL and the LHP are designed to use a fluid to transport waste heat from a controlled device over a long distance and reject it to a heat sink. These systems transfer heat by taking advantage of the latent heat of evaporation, where the heat is absorbed via evaporation and taken out of the system at a sink location where the fluid is condensed. Fluid circulation in both CPL and LHP systems is accomplished entirely by capillary action developed in the ultra-fine pore wicks of the capillary pumps.

The maximum heat transfer capacity of a systems is determined by the capillary limit of the wick. The capillary limit is maximum pressure that a wick can sustain, which is a function of the wick's pore size and the surface tension of the working fluid. As long as the pressure drop in the system is below the capillary limit, the loops will continue to operate. If the system pressure drop exceeds the capillary limit, vapor will be pushed through the wick structure and block off the incoming liquid, thus causing the wick to dry out or "deprime."

Both the CPL and LHP consist of an ECP, a condenser, a reservoir, and vapor and liquid transport lines. Basic operational principles of a CPL and a LHP are very similar: (i) waste heat from a heat source conducts through the ECP body to vaporize liquid on the ECP wick's outer surface, (ii) generated vapor flows in the vapor line to the condenser where heat is removed to condense the vapor back to liquid, and finally (iii) the condensed liquid returns to the ECP in the liquid line to complete the cycle. CPLs are limited by their inability to tolerate vapor in the pump core and have tedious and time-consuming start-up procedures. LHPs are capable of only limited system temperature regulation, but this feature is usually difficult to achieve.

Accordingly, there is a need for a highly reliable heat transport system that is capable of fine temperature control for aerospace and electrical applications. There is a further need for a closed system passive heat transport device that is capable of fast system startup. There is a further need for a closed system passive heat transport device that can prevent vapor accumulation in the system reservoir. Additionally, there is a further need for a closed system passive heat transport device that can operate over a wide temperature range, ranging from cryogenic temperatures to temperatures in excess of 600 degrees Celsius.

SUMMARY OF THE INVENTION

According to the present invention, an advanced loop heat pipe ("ALHP") is provided. The ALHP is a capillary device capable of transporting a large amount of waste heat over a long distance and rejecting it to a heat sink. The ALHP can start, stop, and re-start at any time ("turnkey startup"), provide fine temperature regulation, and operate at cryogenic temperatures without requiring a cooling shield for the return liquid. Furthermore, by selecting a proper working fluid, the ALHP can operate in high temperature and cryogenic temperature ranges.

The ALHP combines the advantageous attributes of both CPLs and LHPs without inheriting operational shortcomings of either one. It starts up quickly and operates reliably like a LHP and also tightly controls the loop operating temperature like a CPL. In addition, the ALHP operates at temperatures far below the surrounding temperature making passive flexible cryocooling possible.

Tight temperature control is accomplished in the ALHP by regulating the mass flow rate of the auxiliary pump ("AP") to maintain the loop temperature at a desired level. The procedures to regulate the AP mass flow rate depend on the type of pump used as the AP. For example, if the AP is a capillary pump, then its mass flow rate is directly proportional to the heater power applied to it. In other words, by increasing or decreasing the AP heater power, the mass flow rate generated by the AP increases/decreases accordingly. If the AP is a mechanical pump, adjusting the pump speed regulates its mass flow rate and thereby controls the loop temperature to a desired level. Or if the AP is an electrohydrodynamic ("EHD") pump, regulating the applied voltage to the pump controls the mass flow rate it produces.

Furthermore, the additional fluid pumping mechanism of the ALHP manages the vapor buildup in the reservoir by removing a predetermined amount of vapor from the reservoir and transporting it to a secondary condenser for heat rejection. As a result, the ALHP can start up quickly and operate reliably like a generic LHP but with the additional capability of temperature control like a CPL. Active removal of vapor buildup in the ALHP reservoir by the auxiliary pump enables the system to operate in severely adverse conditions in which a CPL or an LHP cannot operate. For example, the ALHP can operate in a hot surrounding, the temperature of which is much higher than that of the ALHP without the need for an external thermal shielding mechanism that the CPL and LHP require.

According to an embodiment of the present invention, a heat transfer device includes a reservoir containing a working fluid and a porous wick for transporting the fluid through a closed loop system. It further includes an evaporator capillary pump for conducting heat from an outer surface to the wick inside, changing the state of the working fluid from liquid to vapor. A capillary link 210 between the evaporator capillary pump and the reservoir supplies liquid in the reservoir to the wick of the evaporator capillary pump. An auxiliary pump manages vapor buildup in the reservoir. A primary condenser condenses vapor from the evaporator capillary pump back to liquid state.

A secondary condenser may be implemented as a stand alone condenser or as part of the primary condenser to condense vapor from the reservoir back to liquid state. For cryogenic applications, a swing volume and a pressure reduction reservoir may be implemented to reduce system pressure and system weight.

BRIEF DESCRIPTION OF THE FIGURES

The present invention will be more fully appreciated with reference to the detailed description and appended figures, in which.

DETAILED DESCRIPTION

Figure 1:
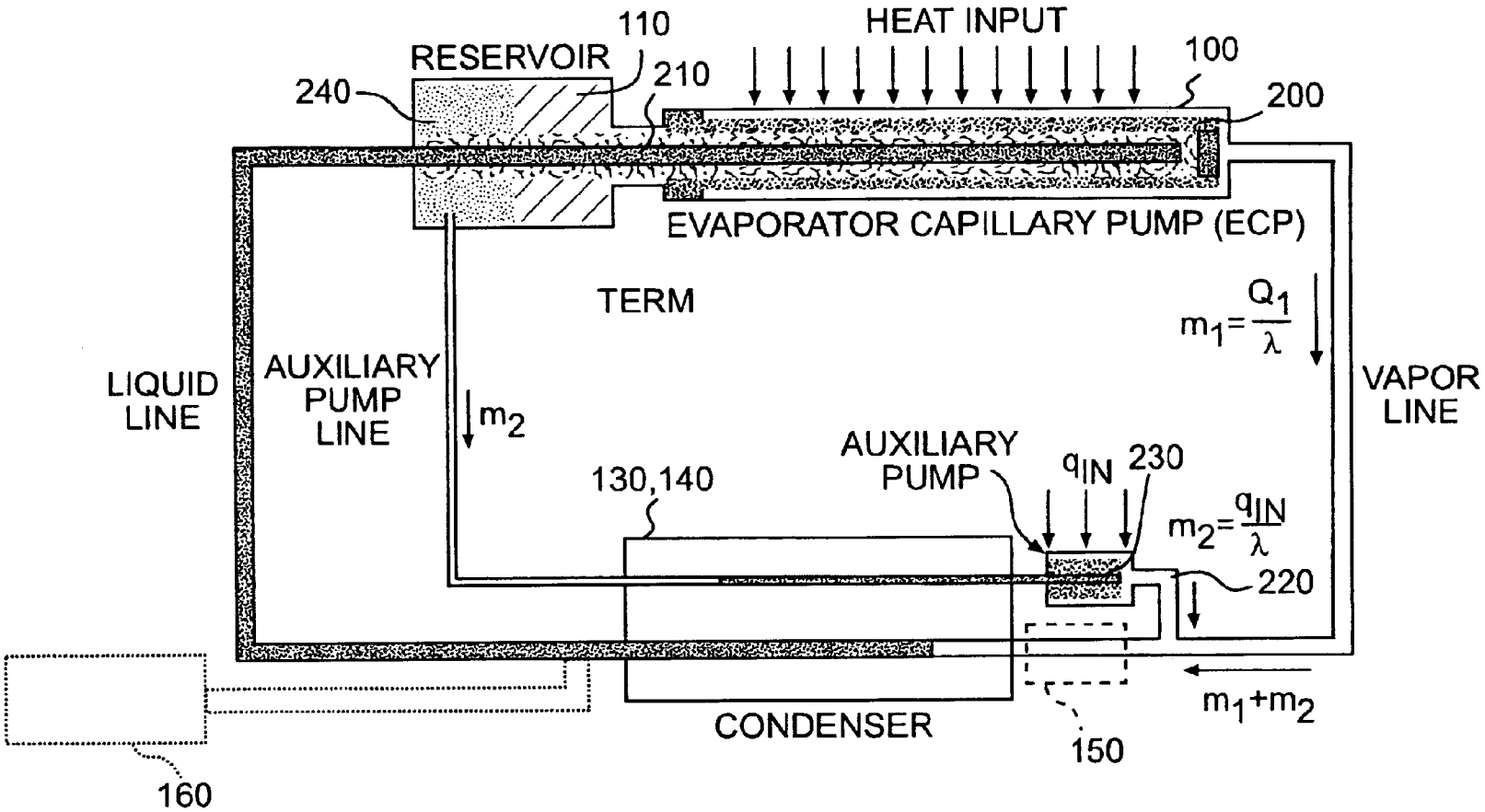
FIG. 1 depicts a functional block diagram of an advanced loop heat pipe system according to an embodiment of the present invention.

According to the present invention, an advanced loop heat pipe ("ALHP") is provided. The ALHP is a capillary device capable of transporting a large amount of waste heat over a long distance and rejecting it to a heat sink. The ALHP can start, stop, and re-start at any time ("turnkey startup"), provide fine temperature regulation, and operate at cryogenic temperatures without requiring a cooling shield for the return liquid. Furthermore, by selecting a proper working fluid, the ALHP can operate in high temperature to cryogenic temperature ranges.

The Advanced Loop Heat Pipe ("ALHP") apparatus is a passive heat transport device utilizing capillary action to circulate a working fluid around the loop. The ALHP is employed to acquire waste heat from a heat source and then to transfer it over a long distance to a heat sink for heat rejection.

FIG. 1 depicts the main components of an ALHP system. The ALHP includes an evaporator capillary pump ("ECP") 100 for heat acquisition, a reservoir 110 for working fluid storage, an auxiliary pump ("AP") 120 for vapor management of the liquid side of the loop, a primary condenser 130 for condensation of vapor from the ECP, and a secondary condenser 140 for condensation of vapor from the reservoir. The secondary condenser 140 may be a separate entity or an integral part of the primary condenser 130. These components are interconnected with transport lines to provide a conduit for the working fluid to flow from one location to another.

The reservoir 110 may be an integral part of the ECP. According to one embodiment of the invention, the reservoir has three holes or ports. One port is an outlet coupled to a fluid line that extends to an inlet port of the ECP. The fluid line fluidly couples the reservoir to the ECP. Another port is an inlet coupled to a fluid line that is fluidly coupled to the condenser and comprises a fluid return path. The reservoir has an third port, an output port, coupled to an auxiliary fluid line. The auxiliary fluid line is used to fluidly couple the reservoir to the AP to remove vapor out of the reservoir. More or fewer ports may be used to couple the fluid lines to the reservoir. For micro-gravity applications, the reservoir may include a wick 240. A wick 240 may be but is generally not implemented in the reservoir for applications on the ground.

The AP may be any pumping device that displaces vapor from the reservoir to the secondary condenser for condensation. In fact, it may be passive (having no mechanical moving part) such as a capillary pump or an electrohydrodynamic ("EHD") pump. Alternatively, the AP may be a positive-displacement mechanical pump. According to another embodiment of the invention, the AP may be a passive/active hybrid pump such as a thermal pulse pump.

When the ALHP is embodied in a system that operates in a cryogenic temperature range (cryogenic ALHP), two additional components may optionally be implemented alone or in combination to minimize the system pressure for fluid charging and safe handling at room temperature.

First, a volume called "swing volume" 150 may be plumbed in-line with the vapor line and located near the heat sink. The swing volume 150 is thermally strapped to a heat sink associated with the condenser so that its temperature is maintained below the working fluid critical temperature for start-up and operation. The second component that may be used for the cryogenic ALHP is called "pressure reduction reservoir" 160. The pressure reduction reservoir is simply a large volume located in a hot environment relative to the operating temperature. It may be connected to the ALHP by a small diameter line as shown in FIG. 1.

FIG. 1 further depicts the fluidic and vapor portions of the fluid lines that inter-couple the components of the system as well as the principle of operation of the ALHP closed loop system. The ALHP is flexible and may be implemented in a variety of ways with a variety of fluids to implement optimum heat control by transporting heat from a device to a remote heat sink. In general, the fluid is chosen based on well know principles of operation of heat pipes and loop heat pipes. In particular, the fluid is chosen based on the desired operating temperature and pressure of the ALHP so that the fluid has its point of evaporation at the optimum temperature and so the fluid does not freeze during operation or cause damage due to freezing after operation is halted.

Referring to FIG. 1, the ECP includes two ports that fluidly couple the ECP to the reservoir and the condenser. The fluid line coupling the ECP to the reservoir generally carries the working fluid in a liquid state. The fluid is transported across the ECP to the distal port which is coupled to the fluid line that leads to the condenser. The ECP itself includes a main wick 200 through which the working fluid passes. The working fluid changes from a liquid to a gaseous state in the ECP and the fluid liquid is wicked from the fluid line coupled to the reservoir to the fluid line coupled to the condenser 130. For optimum heat control, the device that is being controlled should be placed in thermal communication with the ECP in a well known manner.

The condenser is coupled to a heat sink and may be implemented by thermally coupling the vapor line output from the evaporator capillary pump to a cold plate associated with the heat sink (not shown) in a well known manner. For purposes of FIG. 1, the condenser and the cold plate of the heat pump are illustrated as one functional unit 130, 140. The condenser includes fluid couplings to the ECP and to the reservoir.

A problem with loop heat pipes in general is the accumulation of heat and vapor in the reservoir due as a result of "heat leak $\dot{Q}_2$." The total heat leak $\dot{Q}_2$ into the liquid side of the ALHP is the sum of (i) heat conduction across the main wick and (ii) parasitic heat gain from surrounding. Vapor generated by the heat leak eventually accumulates in the reservoir. Without activating the auxiliary pump, the vapor build-up in the reservoir will cause the loop temperature to rise just like a conventional LHP. When the auxiliary pump is in use, it removes an amount of vapor in the reservoir equal to $\dot{m}_2\lambda$ where $\dot{m}_2$ is the mass flow rate generated by the auxiliary pump and $\lambda$ is the latent heat of vaporization of the working fluid. A reduction in vapor build-up in the ALHP reservoir will result in a lower saturation pressure, thereby, decreasing the loop temperature in the process. The higher the mass flow rate $\dot{m}_2$, the more vapor is removed from the reservoir and the lower loop operating temperature will be.

Active removal of vapor build-up in the ALHP reservoir by the auxiliary pump enables the system to operate in severely adverse conditions in which the CPL and LHP cannot. For example, the ALHP can operate in a hot surrounding whose temperature is much higher than its own without requiring an external thermal shielding mechanism like the CPL and LHP. Vapor formed in the ALHP liquid line by environmental heating is removed by the auxiliary pump and transported to the condenser for rejection through an additional vapor line 220 shown in FIG. 1 between the outlet of the auxiliary pump and the vapor line. Note that external thermal shields that CPLs or LHPs require to operate in a hot ambient temperature are intrinsically rigid, preventing them from being used for flexible heat transport applications.

The auxiliary pump may be a mechanical pump, the motor of which is turned on and off when the temperature rises above a predetermined level. The predetermined level is based on the desired operating temperature. Alternatively, the auxiliary pump may be a passive device having a wick 230 shown in FIG. 1 that is turned on by applying heat to the auxiliary pump only when the temperature of the ALHP exceeds the predetermined threshold. The heat may come from a heating element, the reservoir or any other convenient source.

The ALHP may be used in a room temperature environment, such as to provide cooling for ground and space based applications. A few examples are given below:

(a) Thermal Control Systems of Space-Based Instrument

An Ammonia ALHP is capable of (i) acquiring a large amount of waste heat (>1 kW) from spacecraft electronics and batteries, (ii) transporting it to a remotely located radiation for rejection, and (iii) controlling the instrument temperature.

(b) Thermal Control Systems of Military Vehicles or Aircraft

An Ammonia ALHP or a Butane ALHP may be used to transport hundreds of watts of waste heat from on-board electronics to heat exchangers on cooling surfaces of a military vehicles or a leading edge of an aircraft for de-icing.

(c) Miniature ALHP

A water ALHP or a methanol ALHP fluid may be used to provide heat transport for commercial electronic equipment that incorporates a microprocessor. Such equipment may include servers, laptop and desktop computers and other electronics. For miniature implementations, the outer diameter of the capillary pumps typically is less than one quarter of an inch. Microprocessor heat dissipation is on the order of tens of watts and in some cases approaches 200 watts.

(d) Micro ALHP

An entire ALHP may be etched on a Silicon wafer (opposite side of a microchip) to provide heat transport for high-density heat dissipation of a microchip. Water is used as the working fluid. Heat dissipation requirement can reach 100 W/cm$^2$ by the end of the current decade.

The ALHP may also be used in a cryogenic temperature environment. Cryogenic cooling ("cryocooling") is needed primarily for Infrared (IR) sensors/detectors and for maintaining temperatures of high-temperature superconductors below 77 degrees Kelvin. One example of a cryogenic ALHP is the flexible cryo-cooling of IR instrument on-board system. An IR instrument planned for the James Webb Space Telescope requires that the detector be cooled to 20–30K. It needs to remove about 1W of waste heat over a distance of about 2 meters. The transport lines have to be flexible so that the instrument can be isolated from vibration induced by the telescope cryocoolers. A Hydrogen ALHP is suitable for this application.

Furthermore, the ALHP can be used in a high temperature environment. For example, a sodium or potassium ALHP can be employed to move a large amount of heat from a nuclear reactor at high temperature (>600° C.) to a location where thermo-photo-voltaic cells are used to convert heat to electricity.

While particular embodiments of the invention have been depicted and described, it will be understood that changes may be made to those embodiments without departing from the spirit and scope of the invention.

What is claimed is:

1. A closed circulatory system capable of fast system startup, comprising:

a reservoir which contains a working fluid;

at least one evaporator capillary pump ("ECP") in fluid communication with the reservoir for conducting heat from a surface of the ECP to the working fluid inside the ECP, an auxiliary pump for managing vapor buildup in the reservoir and operable to displace vapor mass out of the reservoir at a rate based on the temperature of the working fluid, a primary condenser in fluid communication with the ECP for condensing vapor from the ECP back to liquid state, and a secondary condenser in fluid communication with the reservoir for condensing vapor from the reservoir back to liquid state.

2. The apparatus according to claim 1, further comprising:

a vapor line to fluidly couple the ECP to an inlet of the primary condenser;

a liquid line to fluidly couple the primary condenser outlet to the reservoir;

and an auxiliary pump line to fluidly couple the reservoir to an inlet of the auxiliary pump.

3. The apparatus according to claim 2, further comprising:

an additional vapor line to connect an outlet of the auxiliary pump to the vapor line if the auxiliary pump generates vapor at its outlet.

4. The apparatus according to claim 1, wherein the auxiliary pump is one of a mechanical pump, capillary pump, and electro-hydrodynamic pump that removes a predetermined amount of vapor from the reservoir and transports it to the condenser for heat rejection.

5. The apparatus according to claim 1, wherein the reservoir contains a mixture of liquid and vapor states of the working fluid.

6. The apparatus according to claim 1, wherein the ECP includes a wick and conducts heat from the surface to the working fluid in the wick.

7. The apparatus according to claim 6, further comprising:

a capillary link between the reservoir and the wick for supplying liquid from the reservoir to the wick at all times; and a reservoir wick in the reservoir for fluid management in micro-gravity environments;

wherein the wick of the ECP provides a capillary pumping head for working fluid circulation.

8. The apparatus according to claim 7, wherein the auxiliary pump is a capillary pump and includes an auxiliary pump wick to provide capillary pumping action for removing vapor from the reservoir; and further comprising:

an additional capillary link between the secondary condenser and the auxiliary pump wick for supplying fluid from the secondary condenser to the auxiliary pump wick.

9. The apparatus according to claim 1, wherein the primary and secondary condensers, remove heat and condense the operating vapor to a liquid state.

10. The apparatus according to claim 1, wherein the primary and secondary condensers are part of an integrated condenser.

11. The apparatus according to claim 1, wherein the working fluid is selected as a function of temperature range in which the closed ciculatory system is operated.

12. The apparatus according to claim 1 for cryogenic applications, further comprising:

a swing volume for reducing the system pressure quickly during the start-up process; and a pressure reduction reservoir for minimizing the system pressure for pressure containment and safe handling.

* * * * *